US007484370B2

(12) United States Patent
Kwon et al.

(10) Patent No.: US 7,484,370 B2
(45) Date of Patent: Feb. 3, 2009

(54) REFRIGERANT GAS RECYCLING APPARATUS FOR CRYOGENIC COOLING DEVICE

(75) Inventors: Woon-Sik Kwon, Gyeongsangnam-do (KR); Yeong-Chun Kim, Gyeongsangnam-do (KR); Tae-Sun Moon, Busan (KR); Heui-Joo Park, Gyeongsangnam-do (KR)

(73) Assignee: Doosan Heavy Industries & Construction Co., Ltd., Gyeongsangnam-Do (KR)

( * ) Notice: Subject to any disclaimer, the term of this patent is extended or adjusted under 35 U.S.C. 154(b) by 369 days.

(21) Appl. No.: 11/358,040

(22) Filed: Feb. 22, 2006

(65) Prior Publication Data

US 2007/0186562 A1 Aug. 16, 2007

(30) Foreign Application Priority Data

Feb. 13, 2006 (KR) ..... 10-2006-0013528

(51) Int. Cl.

| | |
|---|---|
| ***F17C 5/02*** | (2006.01) |
| ***F04F 3/00*** | (2006.01) |
| ***E03B 11/00*** | (2006.01) |
| ***E03B 5/00*** | (2006.01) |
| ***F17D 1/00*** | (2006.01) |

(52) U.S. Cl. ..... 62/47.1; 137/571; 137/565.23

(58) Field of Classification Search ..... 62/47.1; 137/571, 565.17, 565.23
See application file for complete search history.

(56) References Cited

U.S. PATENT DOCUMENTS

| | | | | |
|---|---|---|---|---|
| 4,242,885 | A * | 1/1981 | Quack et al. | 62/500 |
| 5,904,737 | A * | 5/1999 | Preston et al. | 8/158 |
| 6,212,916 | B1 * | 4/2001 | Carr | 68/18 R |
| 6,216,302 | B1 * | 4/2001 | Preston et al. | 8/158 |
| 6,345,451 | B1 * | 2/2002 | Arslanian et al. | 34/428 |
| 7,036,324 | B2 * | 5/2006 | Bradley et al. | 62/46.1 |
| 7,131,278 | B2 * | 11/2006 | Svensson et al. | 62/50.1 |
| 2002/0162175 | A1 * | 11/2002 | Berglund | 8/142 |
| 2006/0004239 | A1 * | 1/2006 | Kuechler et al. | 585/639 |

* cited by examiner

*Primary Examiner*—William C Doerrler
(74) *Attorney, Agent, or Firm*—Dickstein Shapiro LLP

(57) ABSTRACT

A refrigerant gas recycling apparatus for cryogenic cooling device has a first gas storage unit for temporarily storing refrigerant gas discharged from the cryogenic cooling device, a compressor for compressing refrigerant gas stored in the first storage unit, and a second gas storage unit for storing therein refrigerant gas compressed by the compressor and selectively re-supplying compressed refrigerant gas to the cryogenic cooling device using a pressure difference between compressed refrigerant gas and inside of the cooling device. Refrigerant gas discharged from the cryogenic cooling device is compressed and stored in reduced volume, and stored refrigerant gas is re-supplied to the cryogenic cooling device without a separate driving source.

8 Claims, 2 Drawing Sheets

REFRIGERANT GAS RECYCLING APPARATUS FOR CRYOGENIC COOLING DEVICE

CROSS-REFERENCE TO RELATED APPLICATION

This application claims all benefits of Korean Patent Application No. 10-2006-13528, filed on Feb. 13, 2006 in the Korean Intellectual Property Office, the disclosures of which is incorporated herein by reference.

BACKGROUND OF THE INVENTION

1. Field of the Invention

The present invention relates to a refrigerant gas recycling apparatus for cryogenic cooling device, and more particularly to a refrigerant gas recycling apparatus for cryogenic cooling device, which compresses and stores therein refrigerant gas discharged from a cryogenic cooling device, and can supply in turn stored refrigerant gas to the cryogenic cooling device.

2. Description of the Prior Art

Generally, it is essential to use a cryogenic cooling device for cooling an object to a critical transition temperature (about 4~77K) generating a superconducting state, in order to study a metallic superconducting state, or a superconducting motor, and so on. Such cooling device cools an object using heat of vaporization of refrigerant gas such as nitrogen, neon, hydrogen, helium and so on.

In the prior art, refrigerant gas to be used in and discharged from the cryogenic cooling device was simply discharged in the air without being recycled, or otherwise stored in a large gas bag such as a balloon at atmospheric pressure so as to re-use it.

However, in case where used refrigerant gas is simply discharged in the air like in the prior art, there causes a problem of generating a risk of damage to the human body or explosion due to toxic components or explosive components that may be contained in refrigerant gas. In addition, since refrigerant gas vaporized and discharged from the cooling device increases in volume a few to several tens times its liquid phase, it causes a problem in that if refrigerant gas is stored in the gas bag, the volume of the gas bag becomes increased excessively.

Further, in the prior cryogenic cooling device, independently constructed are a purge unit for purging inside of the cooling device, a refrigerant gas supply unit, and a refrigerant gas recovery unit, so that the respective units should be separately installed for each process and upon each drive of the units, an operator should drive the units manually, which is troublesome and difficult.

SUMMARY OF THE INVENTION

Accordingly, the present invention has been made to solve the above-mentioned problems occurring in the prior art, and an object of the present invention is to provide a refrigerant gas recycling apparatus for cryogenic cooling device which compresses and stores therein compressed refrigerant gas discharged from the cryogenic cooling device, and re-supply stored refrigerant gas to the cryogenic cooling device without using a separate drive source.

Another object of the present invention is to provide a refrigerant gas recycling apparatus for cryogenic cooling device which makes a purge unit for purging the cryogenic cooling device, a refrigerant gas supply unit, and a unit for recovering refrigerant gas to store and re-supply the same into one piece so that it can recycle refrigerant gas with simplified construction.

Yet another object of the present invention is to provide a refrigerant gas recycling apparatus for cryogenic cooling device which can easily control the driving of the respective constituent elements thereof with a control unit.

In order to accomplish the above objects, there is provided a refrigerant gas recycling apparatus for cryogenic cooling device, the apparatus comprising: a first gas storage unit for temporarily storing refrigerant gas in a gaseous state discharged from the cryogenic cooling device; a compressor for compressing refrigerant gas stored in the first storage unit; and a second gas storage unit for storing therein refrigerant gas compressed by the compressor, and selectively re-supplying compressed refrigerant gas to the cryogenic cooling device using a pressure difference between compressed refrigerant gas and inside of the cooling device.

The refrigerant gas recycling apparatus for cryogenic cooling device may further comprises: a vacuum pump selectively connected with the cryogenic cooling device, the first gas storage unit or the second gas storage unit to make the inside thereof vacuumized so as to purge the cryogenic cooling device, the first gas storage unit or the second gas storage unit; and a refrigerant gas supply unit selectively connected with the cryogenic cooling device, the first gas storage unit or the second gas storage unit to supply refrigerant gas thereto.

The compressor may compress refrigerant gas under 5 to 10 atm to reduce its volume, and store the same in the second gas storage unit.

The refrigerant gas recycling apparatus for cryogenic cooling device may further comprise a heater for heating refrigerant gas discharged from the cryogenic cooling device so as to prevent the apparatus from being so cooled and broken by very low temperature refrigerant gas discharged from the cooling device.

The refrigerant gas recycling apparatus for cryogenic cooling device may further comprise a control unit for controlling the driving of the respective constituent elements thereof.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings.

Figure 1:
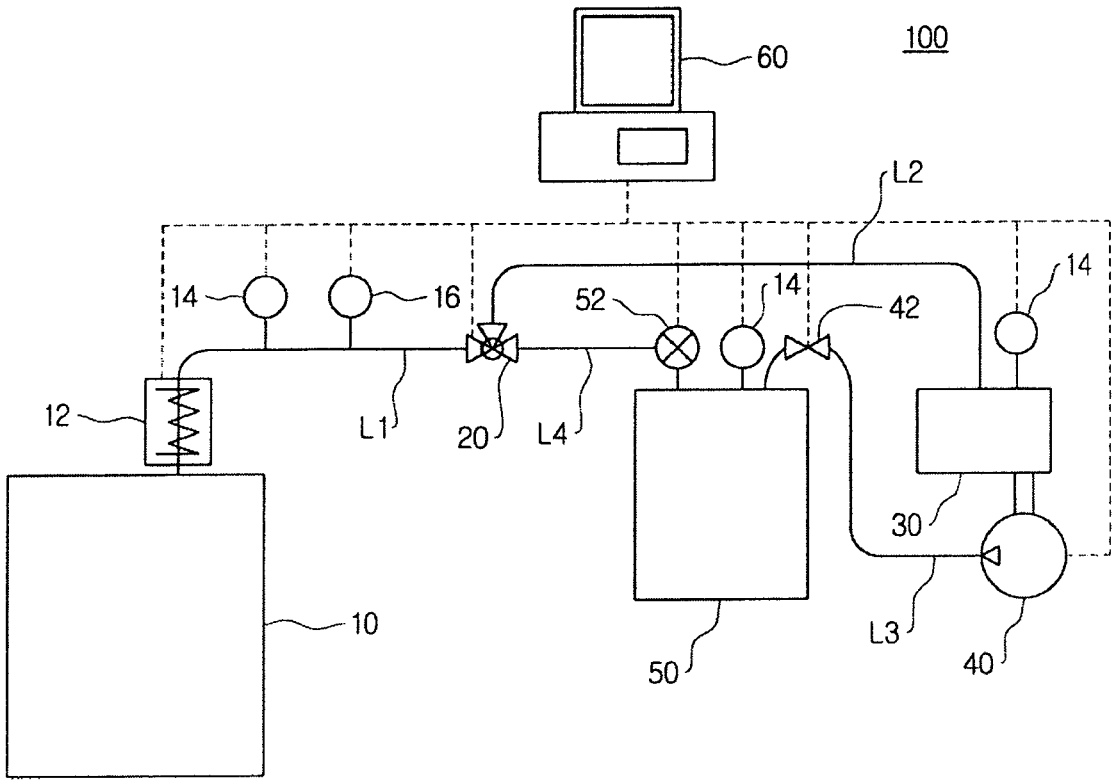
FIG. 1 is a schematic view of a refrigerant gas recycling apparatus according to a preferred embodiment of the present invention.

FIG. 1 is a schematic view of a refrigerant gas recycling apparatus 100 according to a preferred embodiment of the present invention.

Referring to FIG. 1, the refrigerant gas recycling apparatus 100 of the invention includes a first gas storage unit 30 for temporarily storing refrigerant gas discharged from a cryogenic cooling device 10, a heater 12 for heating refrigerant gas discharged from the cryogenic cooling device 10, a compressor 40 for compressing refrigerant gas stored in the first gas storage unit 30, and a second gas storage unit 50 for storing therein compressed refrigerant gas.

The above-mentioned cryogenic cooling device 10, the first and second gas storage units 30 and 50, and the compressor 40 are connected with each other by gas lines and valves described later. The connection structure by the gas lines and the driving of the respective constituent elements will now described in detail.

A cooling device-side line L1 extending from the cryogenic cooling device 10 is connected to a first 3-way valve 20, the other two branches of which form an exhaust line L2 and a re-supply line L4, respectively. The exhaust line L2 is connected to the first gas storage unit 30, which is connected through the compressor 40 to the second gas storage unit 50 via a connection line L3. A 2-way valve 42 is installed on the connection line L3 to regulate the amount of refrigerant gas compressed by the compressor 40 and supplied to the second gas storage unit 50. The second gas storage unit 50 is connected to the first 3-way valve 20 via the above mentioned re-supply line L4.

In the arrangement with above connection structure, refrigerant gas to be used in and discharged in a gaseous state from the cryogenic cooling device 10 is discharged via the cooling device-side line L1. At this time, refrigerant gas being discharged from the cryogenic cooling device 10 becomes to have very low temperature, for example, about −269° C. if it is helium, or −196° C. if it is nitrogen gas. Allowing the flowing of such very low temperature refrigerant gas via the gas lines may cause a risk of over-cooling and even breakage of the gas lines. Accordingly, the heater 12 is preferably installed on the cooling device-side line L1 adjacent to the cryogenic cooling device 10 so as to heat very low temperature refrigerant gas discharged from the cooling device 10 to have a room temperature, thereby preventing the risk of breakage. The heater 12 will not be further described in detail because those of prior art are known in the technical field to which the present invention pertains.

A pressure gauge 14 and a flow meter 16 are installed on the cooling device-side line L1. The pressure gauge 14 and the flow meter 16 measure pressure and flow rate of refrigerant gas flowing in the cooling device-side line L1, and send a measuring result to a control unit 60. The control unit 60 will be described later in detail.

As described above, the line L1 is connected to the first 3-way valve 20, the other two branches of which form the exhaust line L2 and re-supply line L4, respectively. The exhaust line L2 extending from the first 3-way valve 20 is connected to the first gas storage unit 30. Refrigerant gas discharged from the cooling device 10 thus is temporarily stored in the first gas storage unit 30 via the cooling device-side line L1 and the exhaust line L2.

Refrigerant gas temporarily stored in the first gas storage unit 30 is compressed by the compressor 40 and transferred to the second gas storage unit 50 via the connection line L3. The compressor 40 reduces the volume of refrigerant gas temporarily stored in the first gas storage unit 30 through the compression of the same, thereby minimizing the volume of the second gas storage unit 50 for storing refrigerant gas. The compression pressure by the compressor 40 is varied depending upon the kinds of cooling device 10, and in the present invention, refrigerant gas is preferably compressed under 5 to 10 atm. The 2-way valve 42 is installed on the connection line L3 which is controlled to open or close by the control unit 60, thereby regulating the amount of refrigerant gas compressed by the compressor 40 and introduced into the second gas storage unit 50.

The second gas storage unit 50 is connected to the first 3-way valve 20 via a switch 52 and the re-supply line L4. When refrigerant gas has to be supplied to the cryogenic cooling device 10, the present invention re-supplies refrigerant gas stored in the second gas storage unit 50 to the cooling device 10, instead of injecting new refrigerant gas into the cooling device 10. In this case, since refrigerant gas stored in the second gas storage unit 50 is in compressed state under high pressure of 5 to 10 atm, when the switch 52 is opened and the re-supply line L4 and the cooling device-side line L1 are connected to each other by the first 3-way valve 20, refrigerant gas can be supplied from the second gas storage unit 50 to the cryogenic cooling device 10 without a separate driving source by the pressure difference between internal pressures of the second gas storage unit 50 and the cooling device 10.

In addition, pressure gauges 14 are installed on the first and second gas storage units 30 and 50, respectively, so as to measure the pressure of refrigerant gas stored in the storage units and to send a measuring result to the control unit 60.

Meanwhile, the control unit 60 controls the driving of the above-mentioned constituent elements as shown in FIG. 1. In FIG. 1, a hidden line is an imaginary line for visually indicating the status of the constituent elements controlled by the control unit 60. A drive mechanism of the recycling apparatus 100 of the invention to be controlled by the control unit 60 will be hereafter described.

First, in case of recovery of refrigerant gas discharged from the cryogenic cooling device 10, the control unit 60 controls the driving of the heater 12 such that refrigerant gas discharge from the cooling device 10 is heated to a proper temperature, e.g., room temperature. Further, the control unit 60 controls the 3-way valve 30 to serially connect the cooling device-side line L1 and the exhaust line L2, rendering refrigerant gas discharged from the cooling device 10 temporarily stored in the first gas storage unit 30 via the former lines L1 and L2.

Then, the control unit 60 controls the driving of the compressor 40 to compress refrigerant gas stored in the first gas storage unit 30. In this case, the control unit 60 receives pressure data from the pressure gauges 14 each installed on the first and second gas storage units 30 and 50, controls the compressor 40 through the check of difference between pressure data to thus compress refrigerant gas.

Trying to store compressed refrigerant gas in the second gas storage unit 50, the control unit 60 controls the 2-way valve 42 and the switch 52 of the second gas storage unit 50 to be opened and closed, respectively, rendering compressed refrigerant gas stored in the second gas storage unit 50. After refrigerant gas from the cooling device 10 is completely stored in the second gas storage unit 50, the control unit 60 closes the 2-way valve 42 to close the second gas storage unit 50.

Second, in case of re-supply refrigerant gas to the cryogenic cooling device 10, the control unit 60 controls the first 3-way valve 20 to serially connect the re-supply line L4 and the cooling device-side line L1, and opens the switch 52 of the second gas storage unit 50, rendering refrigerant gas stored in the second gas storage unit 50 introduced into the cooling device 10. In this case, as described before, since compressed refrigerant gas is stored in the second gas storage unit 50, refrigerant gas stored in the second gas storage unit 50 can be supplied to the cooling device 10 without a separate driving source by pressure difference between insides of the second gas storage unit 50 and the cooling device 10.

Figure 2:
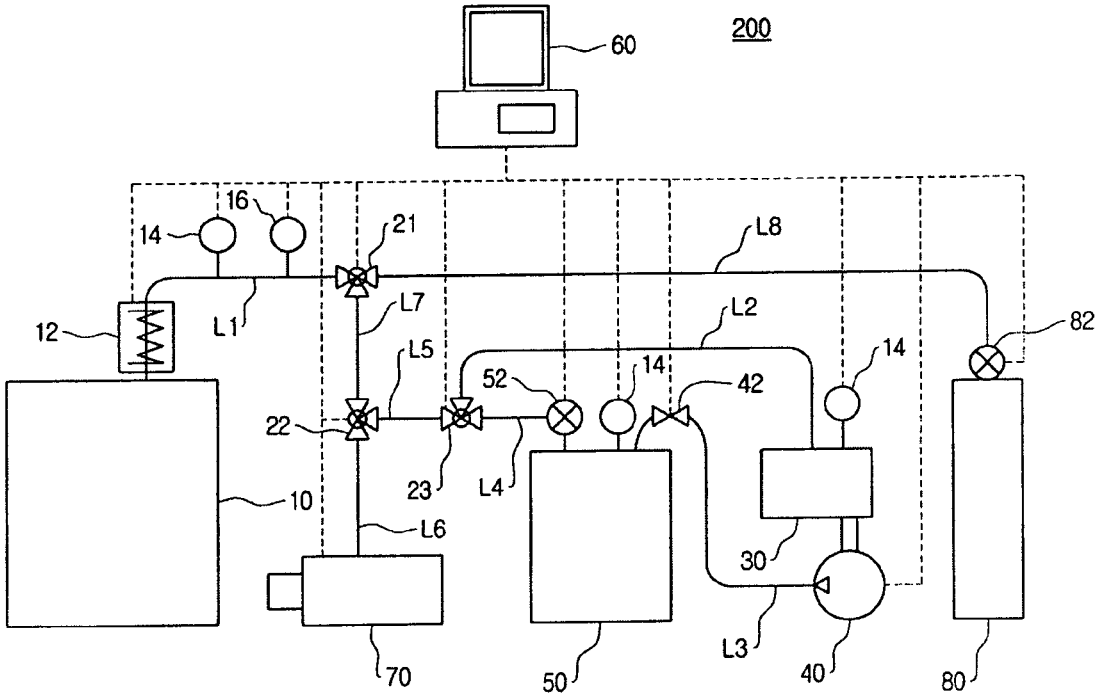
FIG. 2 is a schematic view of a refrigerant gas recycling apparatus according to another preferred embodiment of the present invention.

FIG. 2 is a schematic view of a refrigerant gas recycling apparatus 200 according to another preferred embodiment of the present invention.

As shown in FIG. 2, the present embodiment is different from the embodiment of FIG. 1 in that the present embodiment further includes a vacuum pump 70 and a refrigerant gas supply unit 80. The present embodiment will be described based on the difference. It should be noted that the same reference numerals are used for the same elements across FIGS. 1 and 2.

A cooling device-side line L1 extending from the cryogenic cooling device 10 is connected to a second 3-way valve 21, the other lines of which form a gas supply line L8 connected to the refrigerant gas supply unit 80, and a first intermediate line L7, respectively. The first intermediate line L7 is connected in turn to a third 3-way valve 22, the other two lines of which form a second intermediate line L5 and a pump line L6 connected to the vacuum pump 70, respectively. The second intermediate line L5 is connected to a fourth 3-way valve 23, the other two lines of which form an exhaust line L2 and a re-supply line L4, respectively. The connection structure between the exhaust line L2 and re-supply line L4 and the first and second gas storage units 30 and 50 and the compressor 40 is the same as that of embodiment in FIG. 1, so the detailed description thereof will be omitted.

Comparing to the recycling apparatus of FIG. 1, the refrigerant gas recycling apparatus 200 of FIG. 2 has functions of purging the cryogenic cooling device 10 and the first and second gas storage units 30 and 50 using the vacuum pump 70 before driving the cooling device 10, and supplying initial refrigerant gas to the cooling device 10 using the refrigerant gas supply unit 80, in addition to the function of recovery refrigerant gas discharged from the cooling device 10 to store and re-supply the same.

A driving mechanism for the above functions by the control unit 60 will be now described in detail with reference to FIG. 2.

First, a process of purging a foreign substance in the cooling device 10, i.e., gaseous components other than refrigerant gas, before driving the cryogenic cooling device 10, is as follows:

The control unit 60 controls the second and third 3-way valves 21 and 22 to serially connect the cooling device-side line L1, the first intermediate line L7, and the pump line L6. The control unit 60 drives the vacuum pump 70 to vacuum the inside of the cooling device 10, and controls the second 3-way valve 21 again to connect the cooling device-side line L1 and the gas supply line L8 when the cooling device 10 becomes vacuumized state. After the connection of the cooling device-side line L1 and the gas supply line L8, the control unit 60 opens a switch 82 of the refrigerant gas supply unit 80 to render refrigerant gas supplied into the cooling device 10 via the gas supply line L8 and the cooling device-side line L1. After the supply of small amount of refrigerant gas into the cooling device 10, the control unit 60 controls the second and third 3-way valves 21 and 22 again to serially connect the cooling device-side line L1, the first intermediate line L7, and the pump line L6, and drives the vacuum pump 70 to vacuumize the inside of the cooling device 10 again. The control unit repeats the above-mentioned processes several times, completing the purging process of removing impurities in the cooling device 10.

In case of purging the first gas storage unit 30, the control unit 60 controls the third and fourth 3-way valves 22 and 23 to serially connect the pump line L6, the second intermediate line L5, and the exhaust line L2, closes the 2-way valve 42, and drives the vacuum pump 70, thereby rendering the inside of the first gas storage unit 30 vacuumized. Then, the control unit 60 controls the second, third, and fourth 3-way valves 21, 22, and 23 to serially connect the gas supply line L8, the first and second intermediate lines L7 and L5, and the exhaust line L2 to thus supply the small amount of refrigerant gas from the refrigerant gas supply unit 80 to the first gas storage unit 30. The control unit 60 then vacuumizes the first gas storage unit 30. By repeating the supply and the vacuumizing several times, the purging process of the first gas storage unit 30 is completed.

The process of purging the second gas storage unit 50 is performed similar to that of the first gas storage unit 30. That is, the control unit 60 controls the third and fourth 3-way valves 22 and 23 to serially connect the pump line L6, the second intermediate line L5, and the re-supply line L4, closes the 2-way valve 42, and drives the vacuum pump 70, thereby rendering the inside of the second gas storage unit 50 vacuumized. Then, the control unit 60 controls the second, third, and fourth 3-way valves 21, 22, and 23 to serially connect the gas supply line L8, the first and second intermediate lines L7 and L5, and the re-supply line L4 to thus supply refrigerant gas from the refrigerant gas supply unit 80 to the second gas storage unit 50. The control unit 60 then vacuumizes the second gas storage unit 50. By repeating the supply and the vacuumizing several times, the purging process of the second gas storage unit 50 is completed.

After the purging of the cryogenic cooling device 10, and the first and second gas storage units 30 and 50, the control unit 60 controls the refrigerant gas supply unit 80 to supply initial refrigerant gas to the cooling device 10. Specifically, the control unit 60 controls the second 3-way valve 21 to connect the cooling device-side line L1 and the gas supply line L8, and opens the switch 82 of the refrigerant gas supply unit 80 to supply refrigerant gas into the cooling device 10. In this case, the control unit 60 regulates the amount of refrigerant gas supplied to the cooling device 10, through measuring the pressure and flow rate of refrigerant gas flowing in the cooling device-side line L1, using the pressure gauge 14 and the flow meter 16 installed on the cooling device-side line L1. After the supply of proper amount of refrigerant gas into the cooling device 10, the control unit 60 closes the second 3-way valve 21 to close the cooling device 10 during operation of the cooling device 10.

A process of recovering refrigerant gas discharged by the cooling device 10 to store and re-supply the same is performed similar to that of embodiment in FIG. 1.

That is, in case of temporarily storing refrigerant gas discharged from the cooling device 10 in the first gas storage unit 30, the control unit 60 controls the second, third, and fourth 3-way valves 21, 22, and 23 to serially connect the cooling device-side line L1, the first and second intermediate lines L7 and L5, and the exhaust line L2. Then, a process of compressing refrigerant gas by the compressor 40 and storing the same in the second gas storage unit 50 is performed by the same manner as that of embodiment in FIG. 1, so the detailed description thereof will be omitted.

If it is intended to supply refrigerant gas stored in the second gas storage unit 50 to the cooling device 10 in order to re-drive the cooling device 10, the control unit 60 controls the second, third, and fourth 3-way valves 21, 22, and 23 to serially connect the cooling device-side line L1, the first and second intermediate lines L7 and L5, and the re-supply line L4, and opens the switch 52 of the second gas storage unit 50 to supply refrigerant gas to the cooling device 10. In this case, like the embodiment in FIG. 1, refrigerant gas in the second gas storage unit 50 is introduced into the cooling device 10 without a separate driving source by the pressure difference between insides of the second gas storage unit 50 and the cooling device 10.

The term 'cryogenic cooling device' used in the description means a device for cooling an object to a temperature (about 4~77K), at which superconducting state occurs, in order to generate a superconducting phenomenon of metal or to operate a superconducting motor, but it is not limited thereto. It can be widely adapted to a general cooling device.

In addition, the term 'refrigerant gas' used herein means general coolants used in the cooling device, and may be, preferably, nitrogen, neon, hydrogen, helium, and so on.

As set forth before, a refrigerant gas recycling apparatus for cryogenic cooling device can considerably reduce the volume of a second gas storage unit storing refrigerant gas by compressing refrigerant gas discharged from a cryogenic cooling device.

According to the invention, a refrigerant gas recycling apparatus for cryogenic cooling device compresses refrigerant gas at higher pressure than atmospheric pressure and stores compressed refrigerant gas, so that in case of re-supplying refrigerant gas to the cooling device, it can easily supply the same to the cooling device without a separate driving source by the pressure difference between the cooling device and the gas storage unit.

According to the invention, a refrigerant gas recycling apparatus for cryogenic cooling device makes a purge unit for purging the cryogenic cooling device, an initial refrigerant gas supply unit, and a unit for recovering used refrigerant gas to store and re-supply the same into one piece so that it can recycle refrigerant gas with simplified and easy-assembled construction.

According to the invention, a refrigerant gas recycling apparatus for cryogenic cooling device automatically controls the driving of the constituent elements thereof with a control unit, thereby preventing the troublesome manual driving.

Although preferred embodiments. of the present invention have been described for illustrative purposes, those skilled in the art will appreciate that various modifications, additions and substitutions are possible, without departing from the scope and spirit of the invention as disclosed in the accompanying claims.

What is claimed is:

1. A refrigerant gas recycling apparatus for cryogenic cooling device, the apparatus comprising:

a first gas storage unit for temporarily storing refrigerant gas in a gaseous state discharged from the cryogenic cooling device;

a compressor for compressing refrigerant gas stored in the first storage unit;

a second gas storage unit for storing therein refrigerant gas compressed by the compressor, and selectively re-supplying compressed refrigerant gas to the cryogenic cooling device using a pressure difference between compressed refrigerant gas and inside of the cryogenic cooling device; and a vacuum pump selectively connected with the cryogenic cooling device, the first gas storage unit or the second gas storage unit to make the inside thereof vacuumized.

2. The refrigerant gas recycling apparatus as claimed in claim 1, wherein the compressor compresses refrigerant gas under 5 to 10 atm.

3. The refrigerant gas recycling apparatus as claimed in claim 2, further comprising a heater for heating refrigerant gas discharged from the cryogenic cooling device.

4. The refrigerant gas recycling apparatus as claimed in claim 3, further comprising a control unit for controlling the amount of refrigerant gas stored in the first and second gas storage units, the amount of refrigerant gas supplied from the second gas storage unit to the cryogenic cooling device, and the driving of the compressor and heater.

5. The refrigerant gas recycling apparatus as claimed in claim 1, further comprising a refrigerant gas supply unit selectively connected with the cryogenic cooling device, the first gas storage unit or the second gas storage unit to supply refrigerant gas thereto.

6. The refrigerant gas recycling apparatus as claimed in claim 5, wherein the compressor compresses refrigerant gas under 5 to 10 atm.

7. The refrigerant gas recycling apparatus as claimed in claim 6, further comprising a heater for heating refrigerant gas discharged from the cryogenic cooling device.

8. The refrigerant gas recycling apparatus as claimed in claim 7, further comprising a control unit for controlling the driving of the vacuum pump, the amount of refrigerant gas supplied from the refrigerant gas supply unit, the amount of refrigerant gas stored in the first and second gas storage units, the amount of refrigerant gas supplied from the second gas storage unit to the cryogenic cooling device, and the driving of the compressor and heater.

* * * * *